US011075471B2

(12) United States Patent
Vaccaro et al.

(10) Patent No.: US 11,075,471 B2
(45) Date of Patent: Jul. 27, 2021

(54) COAXIAL CABLE AND CONNECTOR WITH DIELECTRIC SPACER THAT INHIBITS UNWANTED SOLDER FLOW

(71) Applicant: CommScope Technologies LLC, Hickory, NC (US)

(72) Inventors: Ronald A. Vaccaro, Shorewood, IL (US); Yujun Dai, Suzhou (CN); Jin Liu, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/118,040

(22) PCT Filed: Feb. 11, 2014

(86) PCT No.: PCT/CN2014/071971
§ 371 (c)(1),
(2) Date: Aug. 10, 2016

(87) PCT Pub. No.: WO2015/120576
PCT Pub. Date: Aug. 20, 2015

(65) Prior Publication Data
US 2016/0365651 A1 Dec. 15, 2016

(51) Int. Cl.
*H01R 9/05* (2006.01)
*H01R 13/6592* (2011.01)
(Continued)

(52) U.S. Cl.
CPC ..... *H01R 9/05* (2013.01); *H01R 4/028* (2013.01); *H01R 13/6592* (2013.01);
(Continued)

(58) Field of Classification Search
CPC ..... H01R 9/0524; H01R 24/56; H01R 9/05; H01R 4/028; H01R 4/023; H01R 4/022
(Continued)

(56) References Cited

U.S. PATENT DOCUMENTS 4,397,516 A * 8/1983 Koren ..... H01R 24/568 439/584
4,966,560 A * 10/1990 Marzouk ..... H01R 24/58 29/862
(Continued)

FOREIGN PATENT DOCUMENTS

CN 2750499 1/2006
CN 101170232 4/2008
(Continued)

OTHER PUBLICATIONS

International Search Report for corresponding PCT Application No. PCT/CN2014/071971, dated Nov. 18, 2014, 4 pages.
(Continued)

*Primary Examiner* — Abdullah A Riyami
*Assistant Examiner* — Marcus E Harcum
(74) *Attorney, Agent, or Firm* — Myers Bigel, P.A.

(57) ABSTRACT

A coaxial cable-connector assembly includes a coaxial cable and a coaxial connector. The coaxial cable includes a central conductor, an outer conductor, a dielectric layer interposed between the central conductor and the outer conductor, and a jacket overlying the outer conductor. The coaxial connector includes: a central conductor extension configured to mate with a mating connector at one end and mated with the central conductor of the coaxial cable at a second opposite end; an outer conductor extension configured to mate with the mating connector at one end attached via a solder joint to the outer conductor of the coaxial cable at a second opposite end; and a dielectric spacer positioned between and separating the central conductor extension and the outer conductor extension, the dielectric spacer further positioned adjacent the solder joint to inhibit solder flow away from the solder joint.

8 Claims, 2 Drawing Sheets

(51) Int. Cl.
*H01R 24/56* (2011.01)
*H01R 4/02* (2006.01)
*H01R 13/622* (2006.01)

(52) U.S. Cl.
CPC ..... *H01R 24/56* (2013.01); *H01R 24/564* (2013.01); *H01R 13/622* (2013.01)

(58) Field of Classification Search
USPC ..... 439/583, 584, 585
See application file for complete search history.

(56) References Cited

U.S. PATENT DOCUMENTS 5,281,167 A * 1/1994 Le ..... H01R 43/0242 439/578
5,938,474 A * 8/1999 Nelson ..... H01R 9/0521 439/578
6,439,924 B1 * 8/2002 Kooiman ..... H01R 4/023 439/578
6,471,545 B1 * 10/2002 Hosler, Sr. ..... H01R 24/542 439/205
6,786,767 B1 9/2004 Fuks et al.
7,131,868 B2 * 11/2006 Montena ..... H01R 9/0518 439/578
7,527,524 B1 * 5/2009 Coleman ..... H01R 9/0521 439/578
7,635,283 B1 * 12/2009 Islam ..... H01R 9/05 439/583
7,731,529 B1 * 6/2010 Islam ..... H01R 9/0521 439/583
7,785,144 B1 * 8/2010 Islam ..... H01R 9/0521 439/583
7,931,499 B2 * 4/2011 Islam ..... H01R 24/566 439/584
8,984,745 B2 * 3/2015 Paynter ..... H01R 9/05 29/828
9,024,191 B2 * 5/2015 Paynter ..... B29C 45/14598 174/74 A
9,108,348 B2 * 8/2015 Van Swearingen ..... H01R 9/05
9,306,346 B2 4/2016 Vaccaro et al.
9,647,353 B2 * 5/2017 Paynter ..... B23K 3/0475
2005/0118865 A1 * 6/2005 Henningsen ..... H01R 9/0524 439/578
2005/0250381 A1 * 11/2005 Hellin ..... H01R 9/05 439/578
2012/0255991 A1 * 10/2012 Swearingen ..... B23K 1/0016 228/173.1
2013/0084738 A1 * 4/2013 Van Swearingen ..... H01R 13/5845 439/578
2015/0024628 A1 * 1/2015 Haegele ..... H01R 9/05 439/585
2015/0118897 A1 4/2015 Paynter et al.

FOREIGN PATENT DOCUMENTS

FR 2478882 A1 9/1981
JP H11354219 12/1999
WO WO 2012141777 A1 * 10/2012 ..... B23K 35/362

OTHER PUBLICATIONS

Extended European Search Report corresponding to European Application No. 14882519.3, dated Aug. 30, 2017.
Examination Report corresponding to European Application No. 14882519.3, dated Apr. 29, 2019.
Office Action corresponding to Indian Application No. 201617025099 dated Oct. 19, 2019.
Examination Report corresponding to European Application No. 14882519.3, dated Apr. 29, 2020.
Office Action corresponding to Chinese Application No. 201480073982.5 dated Apr. 27, 2020.

* cited by examiner

COAXIAL CABLE AND CONNECTOR WITH DIELECTRIC SPACER THAT INHIBITS UNWANTED SOLDER FLOW

FIELD OF THE INVENTION

The present invention is directed generally to electrical cable connectors, and more particularly to coaxial connectors for electrical cable.

BACKGROUND OF THE INVENTION

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between a cable terminated with a connector bearing the desired connector interface and a corresponding connector with a mating connector interface mounted on an apparatus or on another cable. Typically, one connector will include a structure such as a pin or post connected to an inner conductor and an outer conductor connector body connected to the outer conductor; these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

SUMMARY OF THE INVENTION

As a first aspect, embodiments of the invention are directed to a coaxial cable-connector assembly. The assembly comprises a coaxial cable and a coaxial connector. The coaxial cable comprises a central conductor, an outer conductor, a dielectric layer interposed between the central conductor and the outer conductor, and a jacket overlying the outer conductor. The coaxial connector comprises: a central conductor extension configured to mate with a mating connector at one end and mated with the central conductor of the coaxial cable at a second opposite end; an outer conductor extension configured to mate with the mating connector at one end attached via a solder joint to the outer conductor of the coaxial cable at a second opposite end; and a dielectric spacer positioned between and separating the central conductor extension and the outer conductor extension, the dielectric spacer further positioned adjacent the solder joint to inhibit solder flow away from the solder joint.

As a second aspect, embodiments of the invention are directed to a coaxial cable-connector assembly comprising a coaxial cable and a coaxial connector. The coaxial cable comprises a central conductor, an outer conductor, a dielectric layer interposed between the central conductor and the outer conductor, and a jacket overlying the outer conductor. The coaxial connector comprises: a central conductor extension configured to mate with a mating connector at one end via a projection and mated with the central conductor of the coaxial cable at a second opposite end; an outer conductor extension configured to mate with the mating connector at one end attached via a joint to the outer conductor of the coaxial cable at a second opposite end; and a dielectric spacer positioned between the central conductor extension and the outer conductor extension, the dielectric spacer encircling the projection of the central conductor extension and having an end adjacent the joint.

As a third aspect, embodiments of the invention are directed to a coaxial cable-connector assembly comprising a coaxial cable and a coaxial connector. The coaxial cable comprises a central conductor, an outer conductor, a dielectric layer interposed between the central conductor and the outer conductor, and a jacket overlying the outer conductor. The coaxial connector comprises: a central conductor extension configured to mate with a mating connector at one end and mated with the central conductor of the coaxial cable at a second opposite end; an outer conductor extension configured to mate with the mating connector at one end attached via a joint to the outer conductor of the coaxial cable at a second opposite end; and a dielectric spacer positioned between the central conductor extension and the outer conductor extension, the dielectric spacer having a narrower portion and a wider portion the wider portion having an end adjacent the joint.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
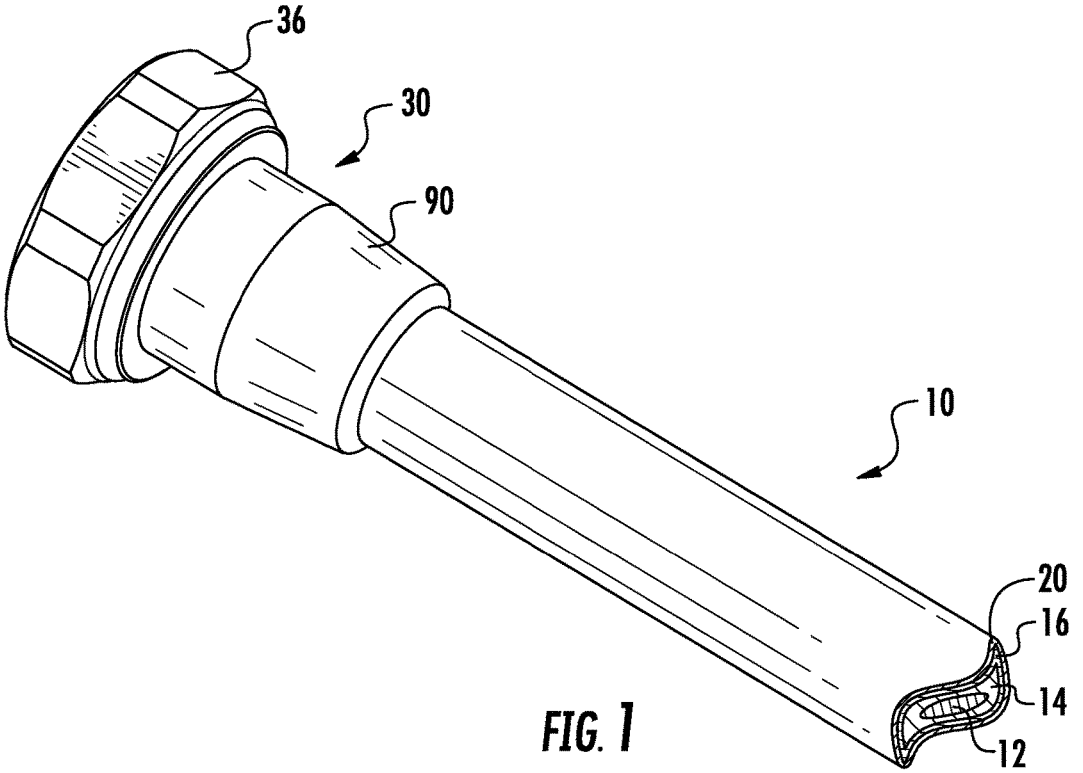
FIG. 1 is a perspective view of a coaxial cable-connector assembly according to embodiments of the invention.
Figure 4:
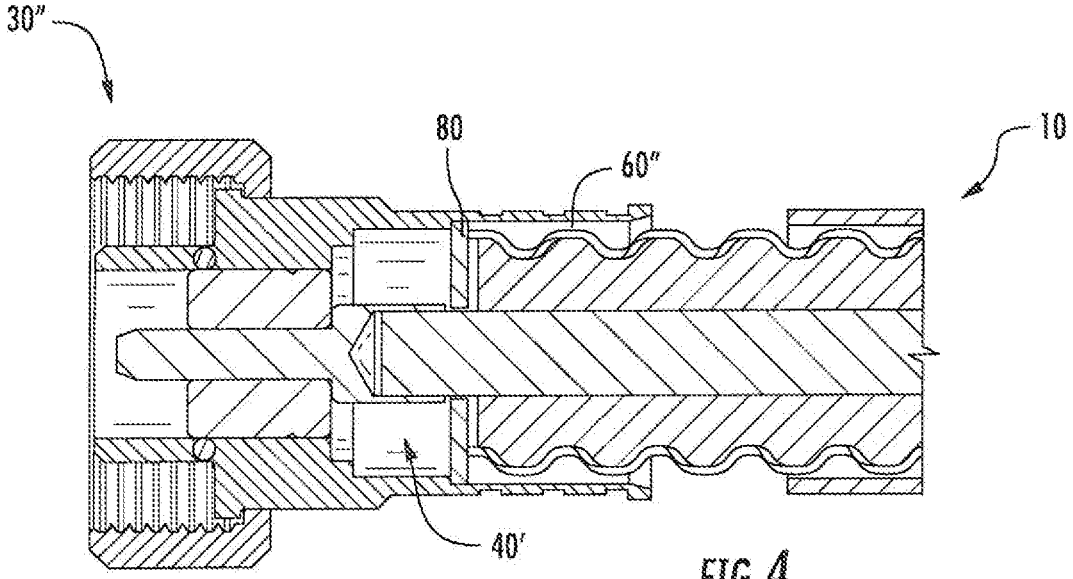
FIG. 4 (PRIOR ART)
FIG. 4 is a partial cross-section of another prior coaxial cable-connector assembly.

FIGS. 1 and 4 illustrate a coaxial cable, designated broadly at 10, according to embodiments of the present invention. As shown in FIG. 1, the cable 10 includes a central conductor 12, a dielectric layer 14 that circumferentially overlies the central conductor 12, an outer conductor 16 that circumferentially overlies the dielectric layer 14, and a polymeric cable jacket 20 that circumferentially overlies the outer conductor 16. These components will be well-known to those of skill in this art and need not be described in detail herein. FIG. 4 illustrates schematically that the outer conductor 16 may be of a corrugated profile; alternatively, the outer conductor of a cable may have a smooth profile. Both of these outer conductor configurations are known to those of skill in this art and need not be described in detail herein.

Figure 3:
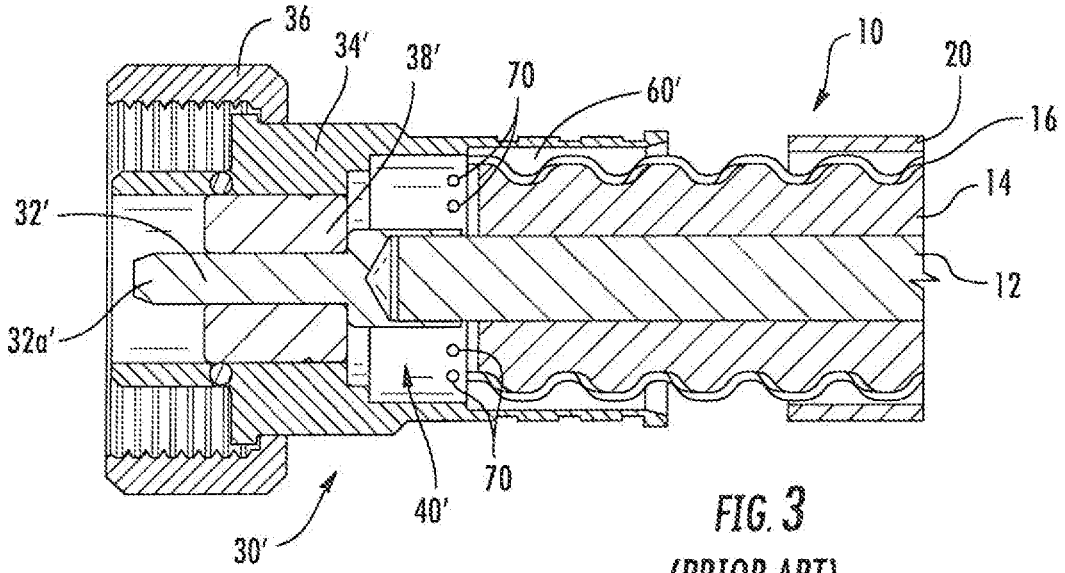
FIG. 3 (PRIOR ART)
FIG. 3 is a partial cross-section of a prior coaxial cable-connector assembly.

FIG. 3 is a cross-sectional view of a prior connector 30' that terminates a coaxial cable. The connector 30' includes a central conductor extension 32' mated with and extending away from the central conductor 12 and an outer conductor extension 34' mated with and extending away from the outer conductor 16. The central conductor extension 32' is configured to mate with the central conductor extension of a mating connector via a post 32*a*'. Similarly, the outer conductor extension 34' is configured to mate with the outer conductor extension of a mating conductor. The interface between mating coaxial connectors will be well known to those of skill in this art and need not be described in detail herein. A coupling nut 36 fits over and is captured by the outer conductor extension 34'.

Referring still to FIG. 3, an annular dielectric insulator 38' of substantially constant thickness extends between the central conductor extension 32' and the outer conductor extension 34'; the dielectric insulator 38' maintains the spacing between the central conductor extension 32' and the outer conductor extension 34', and as such also prevents electrical contact between these components. A cavity 40' is formed between the outer conductor extension 34', the central conductor extension 32', one end of the dielectric spacer 38', and the end of the cable 10.

Attachment of the outer conductor extension 34' to the outer conductor 16 is typically achieved via soldering (note the solder joint 60' in FIG. 3). However, in some instances the solder may leak, seep or otherwise flow into the cavity 40' (this is shown in FIG. 3 as solder balls 70). Such leakage is undesirable, as it may impact the electrical properties of the connector and thereby negatively influence the performance to the connector. One solution to the problem of solder leakage is illustrated in FIG. 4, wherein the connector 30" shown therein includes a dielectric disk 80 positioned at the end of the cable 10, where it can guard the cavity 40' from leaking solder from the solder joint 60" during the soldering process. However, the inclusion of the dielectric disk 80 adds cost to the connector (both in material and labor in assembly), and the dielectric disk 80 is often sufficiently small that it can be easily lost. As such, the dielectric disk 80 does not provide a satisfactory solution to solder leakage.

Figure 2:
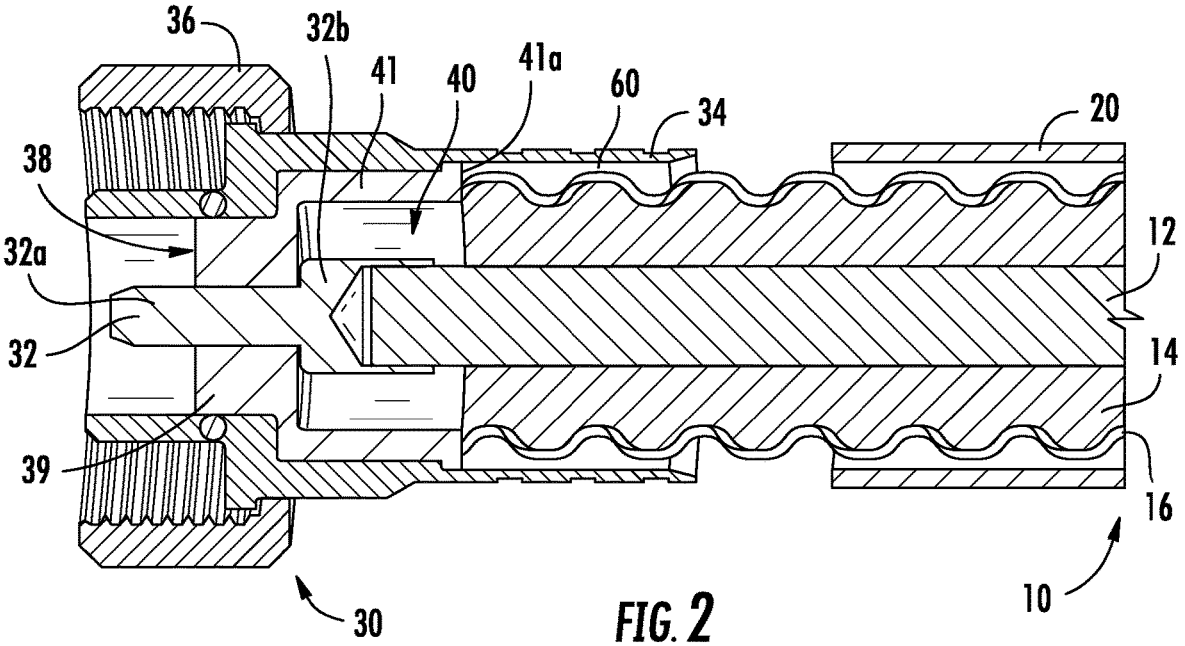
FIG. 2 is a partial cross-section of the coaxial cable-connector assembly of FIG. 1.

Referring now to FIG. 2, the connector 30 shown therein can address the issues presented above. In addition to having a central conductor extension 32 with a post 32*a* and a base 32*b* and an outer conductor extension 34 as described above, the connector 30 also includes a dielectric spacer 38 of a different configuration. More specifically, the dielectric spacer 38 has a stepped configuration, with a narrower portion 39 and a wider portion 41. (As used herein, the "narrower portion" indicates a smaller outer diameter and the "wider portion" indicates a larger outer diameter). The narrower portion 39 encircles the post 32*a* of the central conductor extension 32, thereby spacing and separating the central conductor extension 32 from the outer conductor extension 34 (which encircles the narrower portion 39). The wider portion 41 resides radially inwardly from and contacts the outer conductor extension 34 and resides radially outward from the base 32*b* of the central conductor extension 32. As such, the wider portion 41 defines the radially outward wall of the cavity 40 (rather than the outer conductor extension 34 doing so, as is the case with the connectors 30', 30"). Also, the wider portion 41 extends toward the cable 10 sufficiently that its end 41*a* abuts the end of the outer conductor 16 of the cable 10 adjacent the solder joint 60.

Because the wider portion 41 of the dielectric spacer 38 abuts the cable 10, and in particular abuts the end of the outer conductor 16, it is in position to prevent and/or inhibit solder from flowing away from the solder joint 60 and into the cavity 40 in much the same manner as the dielectric disk 80 shown in FIG. 4. However, because the dielectric spacer 38 is able to combine the functions of the dielectric spacer 38' and the dielectric disk 80, the number of components is reduced, and the size of the dielectric spacer 38 makes it less likely to be lost or misplaced than the dielectric disk 80.

The dielectric spacer 38 may be formed of any dielectric material. In some embodiments, the dielectric spacer 38 may be formed of a polymeric material, such as polytetrafluoroethylene.

Those of skill in this art will recognize that other configurations of the connector 30 may be suitable. For example, either of the inner or outer walls of the dielectric spacer 38 may have a smooth, rather than stepped, profile, such that the dielectric spacer itself is tapered from end to end, the wall of dielectric spacer is tapered from end to end, or both. Also, the central conductor extension 32 may include a sleeve rather than the post 32*a* (the sleeve being configured to receive the post 32*a* during mating), or may have some other variety of projection for mating. The central conductor extension 32 and/or the outer conductor extension 34 may be mated directly to the conductors 12, 16 of the cable 10, or may be mated via an intervening dielectric material, such as that described in U.S. Patent Provisional Application No. 61/835,907, filed Jun. 17, 2013, the disclosure of which is hereby incorporated herein in its entirety. Also, either of the central conductor extension 32 or the outer conductor extension 34 may include a dielectric coating or the like, such that its mating with a mating connector is a capacitive coupling; such an arrangement is discussed in U.S. patent application Ser. No. 14/102,042, filed Dec. 10, 2013, the disclosure of which is hereby incorporated herein in its entirety. Other variations may be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial cable-connector assembly, comprising:

(a) a coaxial cable comprising a central conductor, an outer conductor, a dielectric layer interposed between the central conductor and the outer conductor, and a jacket overlying the outer conductor; and (b) a coaxial connector comprising:

a central conductor extension configured to mate with a mating connector at one end via a projection and mated with the central conductor of the coaxial cable at a second opposite end;

an outer conductor extension configured to mate with the mating connector at one end attached via a solder joint to an end portion of the outer conductor of the coaxial cable at a second opposite end; and a dielectric spacer positioned between the central conductor extension and the outer conductor extension, the dielectric spacer encircling the projection of the central conductor extension and having an end adjacent the joint and axially abutting the end portion of the outer conductor of the coaxial cable;

wherein the dielectric spacer includes a narrower portion with a smaller outer diameter and a wider portion with a larger outer diameter, wherein the narrower portion of the dielectric spacer contacts the outer conductor extension and encircles the projection of the central conductor extension, and wherein the wider portion of the dielectric spacer contacts the outer conductor extension and defines a radially outward wall of a cavity between the central conductor extension and the outer conductor extension, the radially outward wall forming the front end of the solder joint.

2. The coaxial cable-conductor assembly defined in claim 1, wherein the outer conductor extension encircles the narrower portion of the dielectric spacer.

3. The coaxial cable-connector assembly defined in claim 1, wherein the narrower portion and the wider portion define a stepped profile.

4. The coaxial cable-conductor assembly defined in claim 1, wherein the dielectric spacer is formed of a polymeric or insulated material.

5. A coaxial cable-connector assembly, comprising:

(a) a coaxial cable comprising a central conductor, an outer conductor, a dielectric layer interposed between the central conductor and the outer conductor, and a jacket overlying the outer conductor; and (b) a coaxial connector comprising:

a central conductor extension configured to mate with a mating connector at one end and mated with the central conductor of the coaxial cable at a second opposite end;

an outer conductor extension configured to mate with the mating connector at one end attached via a solder joint to the outer conductor of the coaxial cable at a second opposite end;

and a dielectric spacer positioned between the central conductor extension and the outer conductor extension, the dielectric spacer having a narrower portion with a smaller outer diameter and a wider portion with a larger outer diameter, wherein the narrower portion of the dielectric spacer contacts the outer conductor extension, wherein the wider portion of the dielectric spacer contacts the outer conductor extension and has an end adjacent to and abutting the joint, wherein the wider portion of the dielectric spacer defines a radially outward wall of a cavity between the central conductor extension and the outer conductor extension, the radially outward wall forming the front end of the solder joint.

6. The coaxial cable-connector assembly defined in claim 5, wherein the narrower portion encircles a projection of the central conductor extension that is configured to mate with the mating connector.

7. The coaxial cable-conductor assembly defined in claim 6, wherein the outer conductor extension encircles the narrower portion of the dielectric spacer.

8. The coaxial cable-connector assembly defined in claim 5, wherein the narrower portion and the wider portion define a stepped profile.

* * * * *